United States Patent [19]

Dadson

[11] 4,219,162

[45] Aug. 26, 1980

[54] SPRAY NOZZLES FOR SPRAYING LIQUIDS

[75] Inventor: Roland Dadson, Thame, England

[73] Assignee: Hozelock Limited, Aylesbury, England

[21] Appl. No.: 904,298

[22] Filed: May 9, 1978

[51] Int. Cl.[2] ..... B05B 1/32

[52] U.S. Cl. ..... 239/583; 239/526

[58] Field of Search ..... 285/DIG. 22; 248/549, 248/288 R; 239/456, 459, 525, 526, 530, 583, 600

[56] References Cited

U.S. PATENT DOCUMENTS

| | | | |
|---|---|---|---|
| 2,791,454 | 5/1957 | Saives | 285/DIG. 22 |
| 2,991,945 | 7/1961 | Rosenkranz | 239/459 |

FOREIGN PATENT DOCUMENTS

| | | | |
|---|---|---|---|
| 1132384 | 10/1968 | United Kingdom | 248/549 |

*Primary Examiner*—James B. Marbert
*Attorney, Agent, or Firm*—Kenyon & Kenyon

[57] ABSTRACT

A pistol grip spray nozzle for spraying a liquid comprises a nozzle body and a handle pivotally mounted on the nozzle body and movable by manual grip around the handle and nozzle body together to operate a valve within the nozzle body for controlling the flow of liquid issuing from the nozzle body. The handle and the body have co-operating male and female formations, one formation on the nozzle and the other formation on the handle. The male formation fits in the female formation with a snap action to provide the pivotal mounting of the handle on the body, the male and female formations being so arranged that pivoting of the handle to control the flow of fluid tends to maintain the male and female formations fitted together.

4 Claims, 3 Drawing Figures

SPRAY NOZZLES FOR SPRAYING LIQUIDS

This invention relates to spray nozzles for spraying liquids and particularly to pistol grip spray nozzles which are intended to be fitted on the ends of hose pipes for watering gardens, washing down motor vehicles or similar domestic purposes.

A known design of pistol grip nozzle for domestic watering comprises a body and a handle pivotally mounted on the body and movable in order to control the flow of water issuing from the nozzle. The handle is pivotally mounted on the body by means of a rivet, and the present invention aims to provide a form of pivotal connection between the handle and the body which is simpler and cheaper than rivets.

According to the invention, there is provided a pistol grip spray nozzle for spraying a liquid and comprising a nozzle body and a handle pivotally mounted on the nozzle body and movable by manual grip around the handle and the nozzle body together to operate a valve within the nozzle body for controlling a flow of liquid issuing from the nozzle body, the handle and the body having co-operating male and female formations, one formation on the nozzle and the other formation on the handle, the male formation fitting in the female formation with a snap action to provide the pivotal mounting of the handle on the body, the male and female formations being so arranged that pivoting of the handle to control the flow fluid tends to maintain the male and female formations fitted together.

The invention stems from the realisation that the forces imposed on a pivotal mounting of the handle can be used to maintain a snap action connection between the handle and the body together so that separation of the handle and body is not likely to occur in use. If such separation does occur, the formations can simply be pushed together with said snap action.

The following is a more detailed description of one embodiment of the invention, by way of example, reference being made to the accompanying drawings in which.

Figure 1:
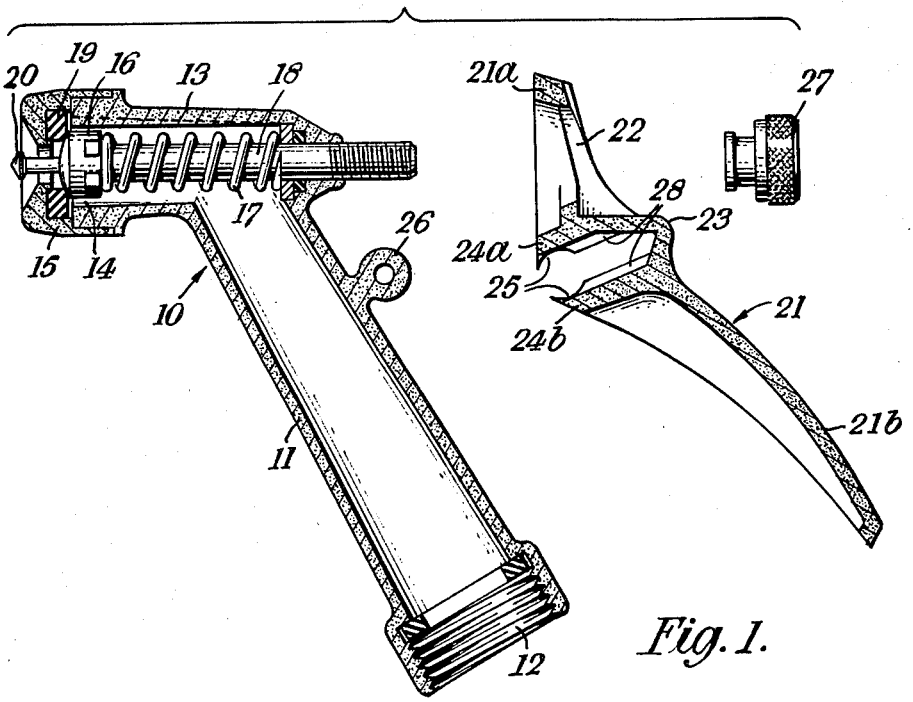
FIG. 1 is an exploded vertical cross-section of a pistol grip spray nozzle according to the invention.

Referring to FIG. 1, the spray nozzle comprises a nozzle body 10 having a hollow handgrip 11 leading from an inlet 12 to a hollow barrel 13 whose outlet 14 has a cap 15 welded thereto. A valve member 16 is within the barrel 13 and a compression spring 17 surrounding a stem 18 of the valve member urges the valve member 16 against a washer 19 in the cap 15 to close the outlet 14 to the barrel 13. A portion of the stem 18 extends through the barrel and is screw threaded.

A water spreader 20 extends from the valve member 16.

A handle 21 for the spray nozzle comprises two parts 21*a*, 21*b*. One part 21*a* is provided with a hole 22 and the other part 21*b* forms a manually gripable portion. The two portions 21*a*, 21*b* are connected by a resiliently flexible knee 23. A jaw 24*a* is formed integrally with said one part 21*a* to one side of the knee 23 and a co-operating jaw 24*b* is formed integrally with said other part 21*b* to the other side of the knee 23. Each jaw 24*a*, 24*b* comprises a part cylindrical inner surface 25 and has a plurality of side-by-side but spaced slots 28 extending therealong in a direction normal to the axis of the associated part cylindrical surface 25. The two jaws 24*a*, 24*b* together form a female formation.

The handgrip 11 is provided with a part cylindrical knuckle 26 serving as a male journal formation.

The handgrip 11, barrel 13 and knuckle 20 are moulded in one piece from a synthetic plastics material as is the handle 21.

Figure 2:
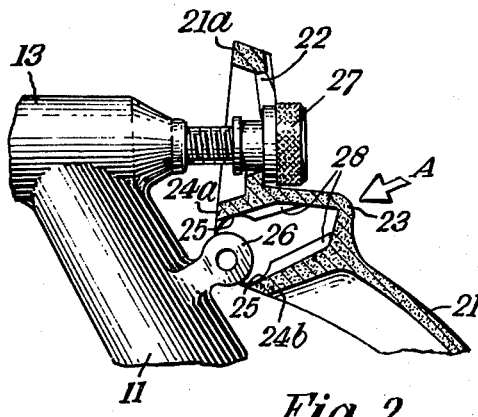
FIG. 2 is a side elevation of a part of the spray nozzle, partly in cross-section, showing a handle of the spray nozzle being fitted to a nozzle body of the spray nozzle.
Figure 3:
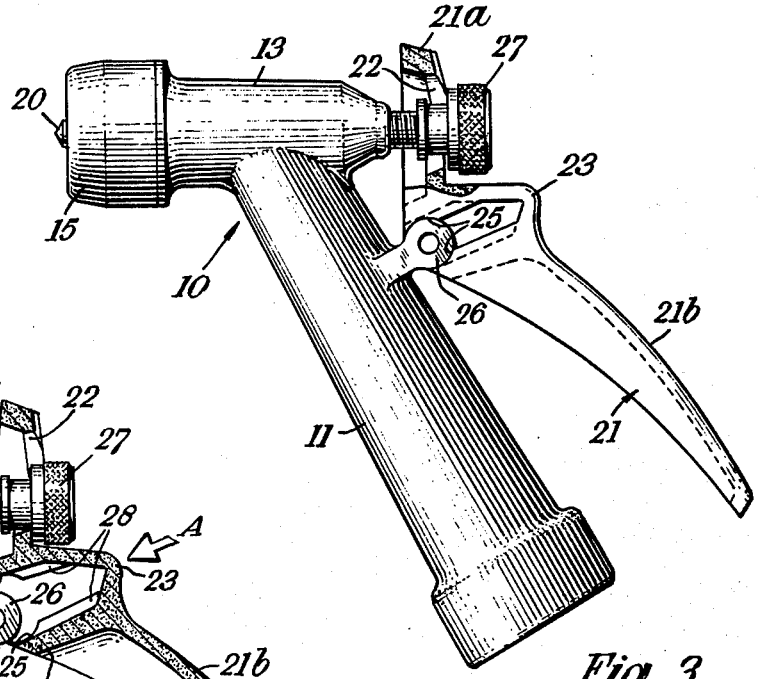
FIG. 3 is a side elevation, partly in section of the spray nozzle fully assembled.

To assemble the handle 21 on the nozzle body 11, the jaws 24*a*, 24*b* are pressed onto the knuckle 26 in the direction of the arrow A in FIG. 2. The slots 28 and the knee 23 impart sufficient resilient flexibility to the jaws 24*a*, 24*b* to allow them to separate and receive the knuckle 26 between their part cylindrical inner surfaces 25 with a snap action. The knuckle 26 and jaws 24*a*, 24*b* provide a pivotal mounting for the handle 21 on the nozzle body 11, as seen in FIG. 3.

The threaded portion of the valve stem 18 extends through the hole 22 in the handle 21. A retaining knob 27 is threaded on the valve stem 18.

In use, the inlet 12 to the handgrip 11 is connected to an end of a hose pipe and the handgrip 11 and the portion 21*b* of the handle 21 are held manually with a pistol grip. Squeezing the handle 21 unseats the valve member 16 from the washer 19 enabling water to issue in a jet from the outlet 14 to the barrel 13. Variation in the pivotal position of the handle 21 varies the spread of the water jet under the control of the spreader 20.

The connection between the knuckle 26 and the jaws 24*a*, 24*b* is maintained in use by the squeezing of the handle 21. In the event of separation of the handle 21 and the handgrip 11, they can be easily snapped together again.

What we claim is:

1. A pistol grip spray nozzle for spraying a liquid and comprising a nozzle body, a valve within the nozzle body for controlling the flow of liquid issuing from the nozzle body, a valve stem extending from the valve to the exterior of the nozzle body, a handle connected to the valve stem for moving the valve stem to operate the valve, a male formation and a female formation which fit together with a snap action, one formation being on the body and the other formation being on the handle to provide a pivotal mounting of the handle on the body, the male formation comprising a part cylindrical knuckle serving as a journal and the female formation being defined by part cylindrical inner surfaces of two spaced jaws serving as a bearing which possess sufficient resilience to be forced apart when the knuckle is pressed into the bearing, the jaws springing back to embrace the knuckle with said snap action, the part of the handle to one side of the pivotable mounting being connected to the part of the handle to the other side of the pivotable mounting by a resiliently flexible knee, one jaw being formed integrally with said one side of the handle and to one side of said knee, and the other jaw being formed integrally with the other side of the handle and to the other side of said knee, whereby the handle can be moved by manual grip around the handle and nozzle body to operate the valve, the pivoting of the handle forcing the male formation and the female formation into engagement with one another.

2. A pistol grip spray nozzle for spraying a liquid and comprising a nozzle body of a plastics material, a valve within the nozzle body for controlling the flow of liquid issuing from the nozzle body, a valve stem extending from the valve to the exterior of the nozzle body, a handle of a plastics material connected at one end thereof to the valve stem to operate the valve, a plastics male formation molded on the valve body, a plastics female formation molded on the handle intermediate the ends of the handle and engaging the plastics male formation with a snap-action to provide a pivotal mounting for the handle on the nozzle body intermediate the ends of the handle, the male formation comprising a part cylindrical knuckle serving as a journal and the female formation being defined by part cylindrical inner surfaces of two spaced jaws serving as a bearing which possess sufficient resilience to be forced apart when the knuckle is pressed into the bearing, the jaws springing back to embrace the kncukle with said snap action, the part of the handle to one side of the pivotable mounting being connected to the part of the handle to the other side of the pivotable mounting by a resiliently flexible knee, one jaw being formed integrally with said one side of the handle and to one side of said knee, and the other jaw being formed integrally with the other side of the handle and to the other side of said knee, whereby the handle can be moved to operate the valve by manual grip around the end of the handle remote from its connection to the valve shaft, such pivoting forcing the male and female formations into engagement with one another.

3. A pistrol grip spray nozzle according to claim 1 or 2 wherein the jaws include a plurality of side-by-side but spaced slots extending along the inner surfaces of the jaws in a direction normal to the axis of the part cylindrical surfaces.

4. The pistol grip spray nozzle recited in claims 1 or 2, wherein the formation on the handle is disposed intermediate the ends thereof so that the ends of the handle are pivotal about the formation, the handle being connected to the valve stem adjacent one end of the handle.

* * * * *